US011174077B2

(12) United States Patent
Dais et al.

(10) Patent No.: US 11,174,077 B2
(45) Date of Patent: Nov. 16, 2021

(54) STORAGE BAG WITH SHAPE-RETAINING STRIPS AT OPENING AND AN EXPANDABLE BOTTOM END

(75) Inventors: Brian C. Dais, Saginaw, MI (US); Bryan L. Ackerman, Freeland, MI (US); Keegan E. Burggren, Midland, MI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 13/528,248

(22) Filed: Jun. 20, 2012

(65) Prior Publication Data

US 2013/0343676 A1 Dec. 26, 2013

(51) Int. Cl.
*B65D 33/00* (2006.01)
*B65D 33/25* (2006.01)

(52) U.S. Cl.
CPC ..... *B65D 33/007* (2013.01); *B65D 33/2591* (2013.01)

(58) Field of Classification Search
CPC .... B65D 33/2591; B65D 33/007; B65B 7/20; B65B 7/22
USPC ..... 383/33, 64, 65
See application file for complete search history.

(56) References Cited

U.S. PATENT DOCUMENTS 4,541,117 A 9/1985 Ashbeck
5,027,965 A * 7/1991 Dumars ..... B63B 25/082 114/211
5,133,607 A * 7/1992 Bonke ..... 383/75
5,174,658 A * 12/1992 Cook ..... B65D 33/007 150/900
5,184,896 A 2/1993 Hammond et al.
5,354,132 A * 10/1994 Young et al. ..... 383/49
5,956,924 A 9/1999 Thieman
6,022,144 A * 2/2000 Hausslein ..... B65D 33/30 383/33
6,139,185 A * 10/2000 Hamilton et al. ..... 383/11
6,209,287 B1 4/2001 Thieman
6,216,423 B1 4/2001 Thieman
(Continued)

FOREIGN PATENT DOCUMENTS

JP H01-179843 U 12/1989
JP 2001-0522764 A 11/2001
(Continued)

OTHER PUBLICATIONS

Written Opinion dated Nov. 20, 2013, in corresponding International Application No. PCT/US2013/046459.
(Continued)

*Primary Examiner* — Derek J Battisti

(57) ABSTRACT

A storage bag has first and second side surfaces, and a sealable and an unsealable opening. A bottom end of the bag is movable between a flat configuration with the first and second side surfaces positioned adjacent to each other, and an expanded configuration with the first and second side surfaces being spaced from each other. Shape retaining strips are provided adjacent to the opening that can maintain the shape of the opening. The shape retaining strips are capable of maintaining the opening of the bag such that a distance between the first and second side surfaces at the top end of the bag is about equal to the distance between the first and second side surfaces at the bottom end of the bag.

9 Claims, 9 Drawing Sheets

(56) References Cited

U.S. PATENT DOCUMENTS

| | | | | |
|---|---|---|---|---|
| 6,247,843 | B1 * | 6/2001 | Buchman | B65D 33/2591 383/202 |
| 6,290,392 | B1 * | 9/2001 | Sandor | B65D 33/2541 383/33 |
| 6,361,210 | B2 * | 3/2002 | Denko | 383/35 |
| 6,363,692 | B2 | 4/2002 | Thieman | |
| 6,438,926 | B1 | 8/2002 | Thieman | |
| 6,499,272 | B2 | 12/2002 | Thieman | |
| 6,827,491 | B2 | 12/2004 | Kohl et al. | |
| 6,899,460 | B2 | 5/2005 | Turvey et al. | |
| 6,907,713 | B2 | 6/2005 | Thieman | |
| 6,918,230 | B2 | 7/2005 | Thieman | |
| 6,925,779 | B2 | 8/2005 | Thieman | |
| 6,942,608 | B2 | 9/2005 | Linton et al. | |
| 6,951,421 | B2 | 10/2005 | Crunkleton et al. | |
| 6,962,034 | B2 | 11/2005 | Thieman | |
| 6,962,440 | B2 | 11/2005 | Fenzl et al. | |
| 6,981,299 | B2 * | 1/2006 | Savicki, Sr. | 24/399 |
| 7,134,192 | B1 * | 11/2006 | Savicki et al. | 29/766 |
| 7,140,772 | B2 * | 11/2006 | Bois et al. | 383/59 |
| 7,291,370 | B2 * | 11/2007 | Gipson et al. | 428/36.1 |
| 7,320,662 | B2 | 1/2008 | Thieman | |
| 7,364,361 | B2 | 4/2008 | Turvey et al. | |
| 7,383,675 | B2 | 6/2008 | Thieman | |
| 7,416,338 | B2 * | 8/2008 | Ausnit | 383/64 |
| 7,506,487 | B2 * | 3/2009 | Eads | B65D 31/10 383/203 |
| 7,540,662 | B2 | 6/2009 | Thieman | |
| 2003/0077007 | A1 | 4/2003 | Turvey et al. | |
| 2003/0215160 | A1 * | 11/2003 | Kohl | B65D 33/007 383/33 |
| 2011/0069911 | A1 | 3/2011 | Ackerman et al. | |
| 2011/0188785 | A1 | 8/2011 | Turvey et al. | |
| 2013/0177262 | A1 * | 7/2013 | Anzini | B65D 33/007 383/33 |

FOREIGN PATENT DOCUMENTS

| | | | | |
|---|---|---|---|---|
| JP | 2003-040290 | A | 2/2003 | |
| JP | 2004-244114 | A | 9/2004 | |
| JP | 2004-256120 | A | 9/2004 | |
| JP | 2004256120 | * | 9/2004 | B65D 30/16 |
| JP | 2005-035148 | A | 2/2005 | |
| JP | 2005-506938 | A | 3/2005 | |
| JP | 2005-088893 | A | 4/2005 | |
| JP | 2007191200 | A | 8/2007 | |
| JP | 2007246140 | A | 9/2007 | |
| JP | 2008044616 | A | 2/2008 | |

OTHER PUBLICATIONS

PCT/US2013/046459 International Search Report dated Nov. 20, 2013.

Japanese Official Action dated Mar. 29, 2016, issued in corresponding Japanese Patent Application No. 2015-518534, with an English translation.

Decision of Dismissal of Amendment dated Jul. 3, 2017, issued in corresponding Japanese Patent Application No. 2015-518534, with an English translation.

Decision of Rejection dated Jul. 3, 2017, issued in corresponding Japanese Patent Application No. 2015-518534, with an English translation.

Office Action dated Aug. 28, 2018, issued in corresponding Japanese Patent Application No. 2017-202807.

Office Action dated Jan. 18, 2019, issued in corresponding Japanese Patent Application No. 2015-518534.

Office Action dated Aug. 22, 2019, issued in corresponding Japanese Patent Application No. 2017-202807.

* cited by examiner

STORAGE BAG WITH SHAPE-RETAINING STRIPS AT OPENING AND AN EXPANDABLE BOTTOM END

BACKGROUND

Field of the Invention

Our invention relates to a storage bag. More specifically, our invention relates to a storage bag with features for maintaining the opening of the bag, and maintaining the opening to a size that is about equal to a size of the bottom end of the bug.

Related Art

Storage bags or pouches made from flexible plastic materials are well known. Such bags can be used to store a variety of items, with one of the most common uses being the storage of perishable food. In order to effectively preserve food, and in order to prevent food or other items from leaking out of a storage bag, the storage bag often includes a sealing mechanism for closing the opening of the bag. One common type of sealing mechanism, which is often referred to as a fastener assembly or a zipper, includes interlocking closure profiles at a top end of a bag. The interlocking closure profiles are pressed and pulled apart by a slider that is movable across the top end of the bag, thereby sealing and unsealing the opening of the bag. Examples of storage bags that include such a scaling mechanism are sold by the assignee of this application under the ZIPLOC® trademark.

In filling a storage bag, materials are passed through the opening to the interior of the bag. Given the usual size of storage bags, coupled with the inherent difficulty of manipulating some materials, it can sometimes be difficult for a person to maintain the opening of the bag open while directing materials into the bag. It is advantageous, therefore, to provide a storage bag with a structure to maintain the opening of the bag open. Further, it is advantageous to configure the bag such that the bag will stand upright during the filling operation.

One example of a structure for maintaining the opening of a storage bag open is shown in U.S. Pat. No. 7,364,361, the disclosure of which is incorporated herein in its entirety, in this patent, a storage bag includes a sealing mechanism that closes the opening. When unsealed, a biasing rail maintains the opening of the bag open. Unis, anytime the bag is unsealed, the opening of the bag will have a non-flat shape.

An example of maintaining the shape of an opening of a bag is shown in Japanese Patent Application Pub. No. 2005-88893. In this publication, a shape-retaining tape is provided adjacent to the mouth of a bag such that the mouth of the bag can be maintained in any shape. Apparently, in Older to allow for differently shaped openings, and in order to allow the bag to be folded into different shapes, the bag set forth in Japanese Patent Application Pub. No. 2005-88893 does not include a sealing mechanism. In order to further allow the bag to be folded and formed into different shapes, the bag set forth in this publication does not have discernable sides or a bottom.

SUMMARY OF THE INVENTION

According to one aspect of our invention, a storage bag is provided. The storage bag includes a first side surface and a second side surface connected to the first side surface so as to form an interior of the bag with an opening thereto. A first fastener strip is positioned adjacent to the opening of the bag, with the first fastener ship including at least one interlocking profile and a flange extending below the at least one interlocking profile. A portion of the flange is attached to the first side surface. A second fastener strip is positioned adjacent to the opening of the bag, with the second fastener strip including at least one interlocking profile and a flange extending below the at least one interlocking profile. A portion of the flange is attached to the second side surface. A slider is configured to press together the at least one interlocking profile of the first fastener strip and the at least one interlocking profile of the second fastener strip as the slider moves from the first end to the second end of the bag. The slider is also configured to separate the at least one interlocking profile of the first fastener strip and the at least one interlocking profile of the second fastener strip as the slider moves from the second end to the first end of the bag. A first shape-retaining strip formed from a shape-retaining material is provided between the flange of the first fastener strip mid the first side surface of the bag, and a second shape-retaining strip formed from a shape-retaining material is provided between the flange of the second fastener strip and the second side surface of the bag.

A storage bag is provided according to another aspect of our invention. This storage bag includes a first side surface, and a second side surface connected to the first surface so as to form an interior of the bag with an opening thereto. A first fastener strip is positioned adjacent to the opening, with the first fastener strip including at least one first interlocking profile. A second fastener strip is positioned adjacent to the opening, with the second fastener strip including at least one second interlocking profile. A slider is configured to press together the at least one interlocking profile of the first fastener strip and the at least one interlocking profile of the second fastener strip as the slider moves from the first end to the second end of the bag. The slider is also configured to separate the at least one interlocking profile of the first fastener strip and the at least one interlocking profile of the second fastener strip as the slider moves from the second end to the first end of the bag, A first shape-retaining strip is positioned adjacent to the first fastener strip, and a second shape-retaining strip is positioned adjacent to the second fastener strip. The first and second shape-retaining strips are capable of maintaining a first position in which the opening of the bag is substantially closed with the first and second fastener strips positioned adjacent to each other. The first and second shape-retaining strips are also capable of maintaining a second position in which the opening of the bag is substantially open with the first and second fastener strips separated from each other.

A storage bag is provided according to yet another aspect of our invention. The storage bag includes a first side surface and a second side surface connected to the first surface so as to form an interior of the bag with an opening thereto. The first side surface is directly connected to the second side surface along a first end of the bag and a second end of the bag, and the first side surface is connected to the second side surface at a bottom end of the bag with a k-seal connection that is changeable between (it a flat configuration with the first side surface positioned adjacent to the second side surface at the bottom end, and (ii) an expanded configuration with the first side surface spaced from the second side surface at the bottom end. A first fastener strip is positioned adjacent to the opening, with the first fastener strip including at least one interlocking profile. A second fastener strip is positioned adjacent to the opening, with the second fastener strip including at least one interlocking profile. A first shape-retaining strip is positioned adjacent to the first fastener strip, and a second shape-retaining strip is positioned adjacent to the second fastener strip. The first and second shape-retaining strips are capable of maintaining the opening of the bag such that a distance from the first side surface to the second side surface at the opening is about equal to the distance from the first side surface to the second side surface at the bottom end of the bag.

Figure 1:
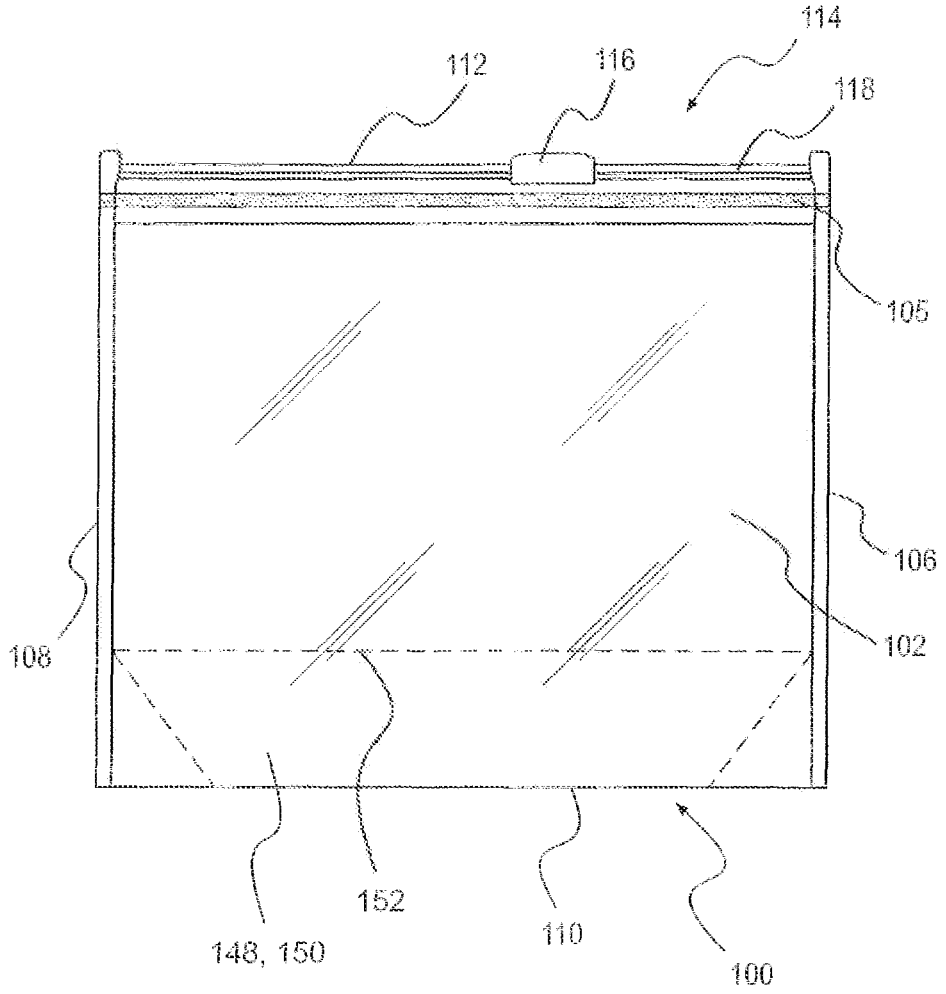
FIG. 1 is a side view of a bag according to an embodiment of the invention.

FIG. A is a view of the bottom end of the bag shown in FIG. 1 in the extended configuration.

Figure 5:
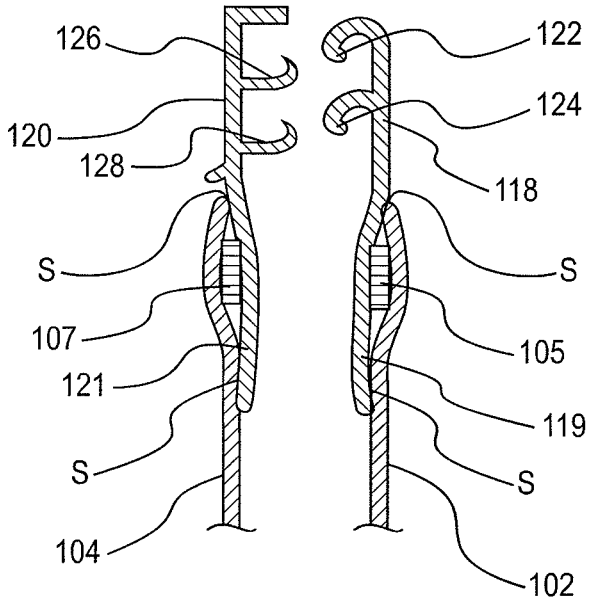

FIG. 5 is a view of fastener strips and a shape-retaining material according to an embodiment of the invention.

Figure 6:
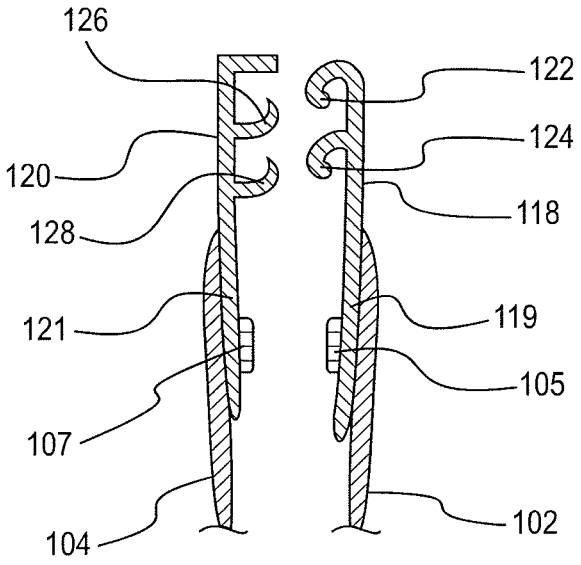

FIG. 6 is a view of fastener strips and a shape-retaining material according to an alternative embodiment of the invention.

Figure 7:
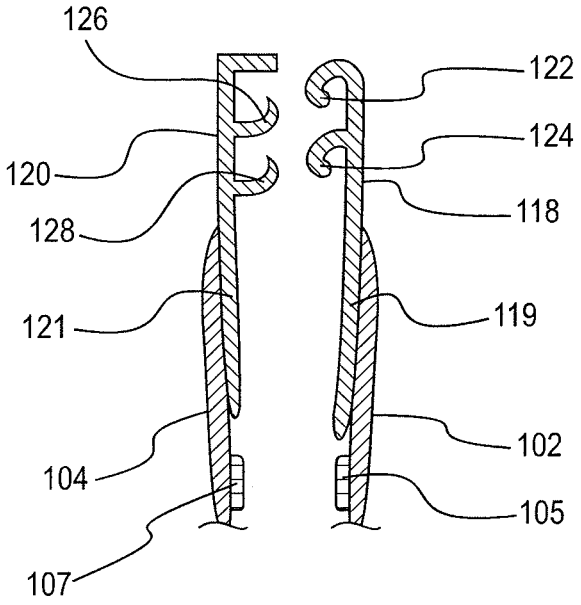

FIG. 7 is a view of fastener strips and a shape-retaining material according to yet another alternative embodiment of the invention.

Figure 8:
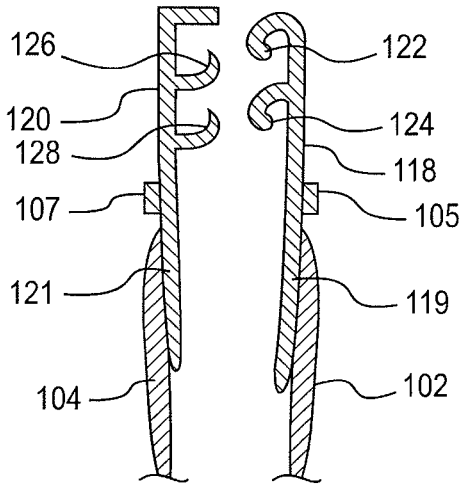

FIG. 8 is a view of fastener strips and a shape-retaining, material according to a further alternative embodiment of the invention.

Figure 9:
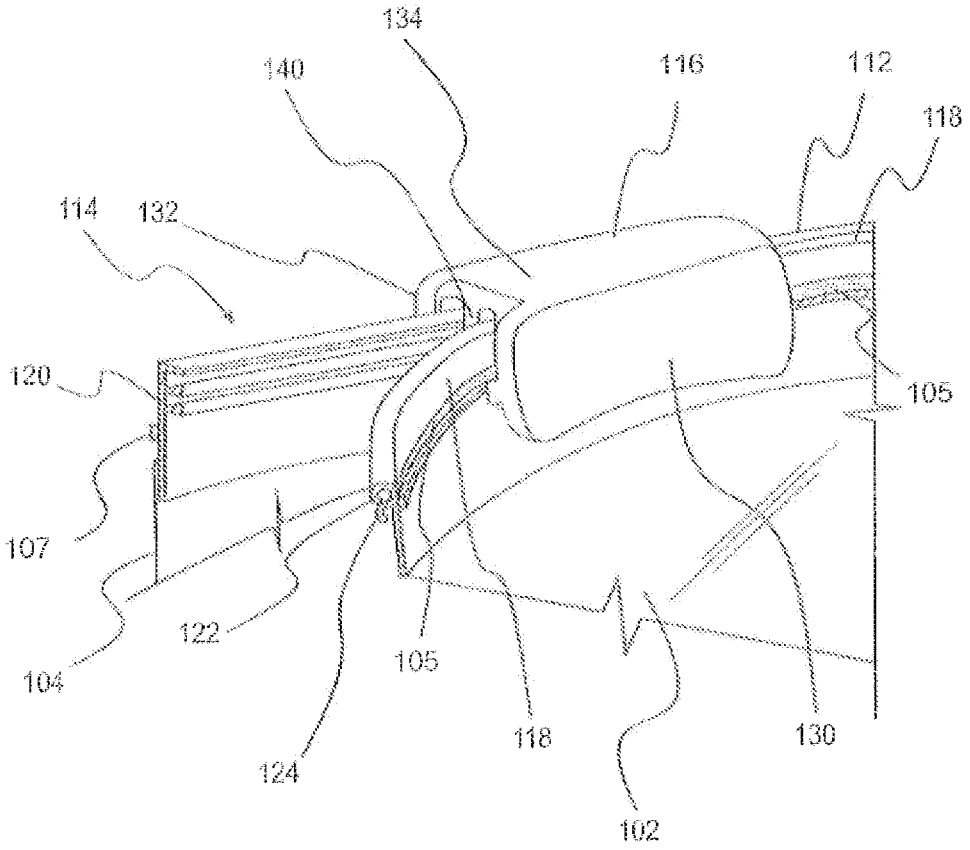

FIG. 9 is an elevation view of the fastener assembly of a bag according to the invention.

Figure 10:
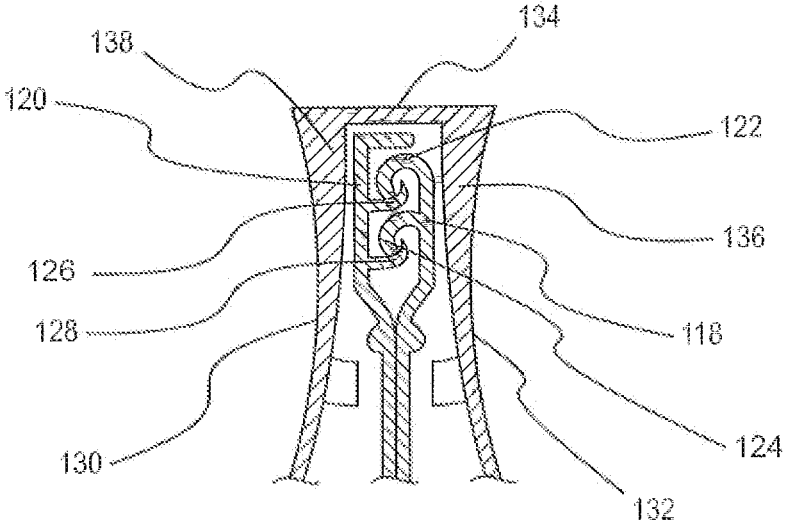

FIG. 10 is a cross-sectional view of the fastener assembly being closed by a slider according to the invention.

Figure 11:
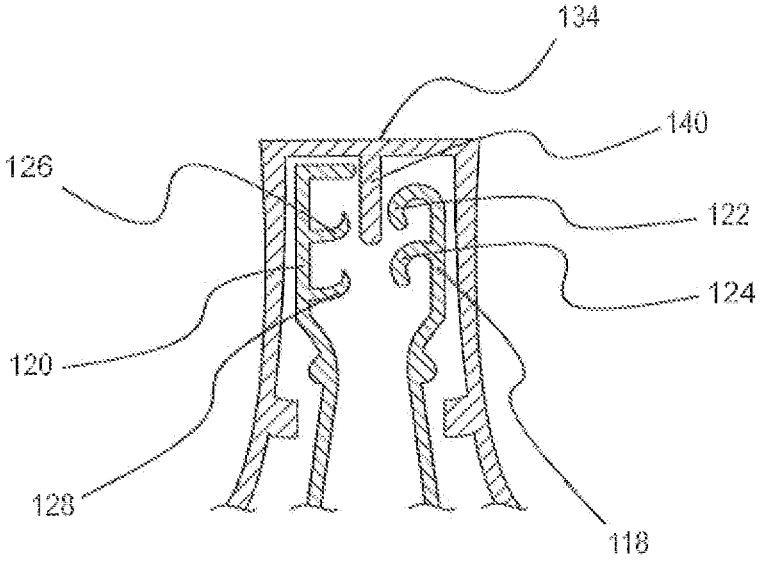

FIG. 11 is a cross-sectional view of the fastener assembly being opened by a slider according to the invention.

DETAILED DESCRIPTION OF THE INVENTION

Our invention relates to a storage bag that includes features for maintaining open an unsealed opening to the interior of the bag. The bag may further have a bottom end that is changeable between a flat and an expanded configuration, with the opening being maintained at a size that is substantially equal to the size of the expandable bottom of the bag.

As will be apparent from the description herein, the term "bag" encompasses a broad range of structures designed to contain items, such as pouches; envelopes, packets, and the like. In general, the term bag as used herein simply means a somewhat flexible container with an opening, with the bag being useable to carry any number of items.

Figure 2:
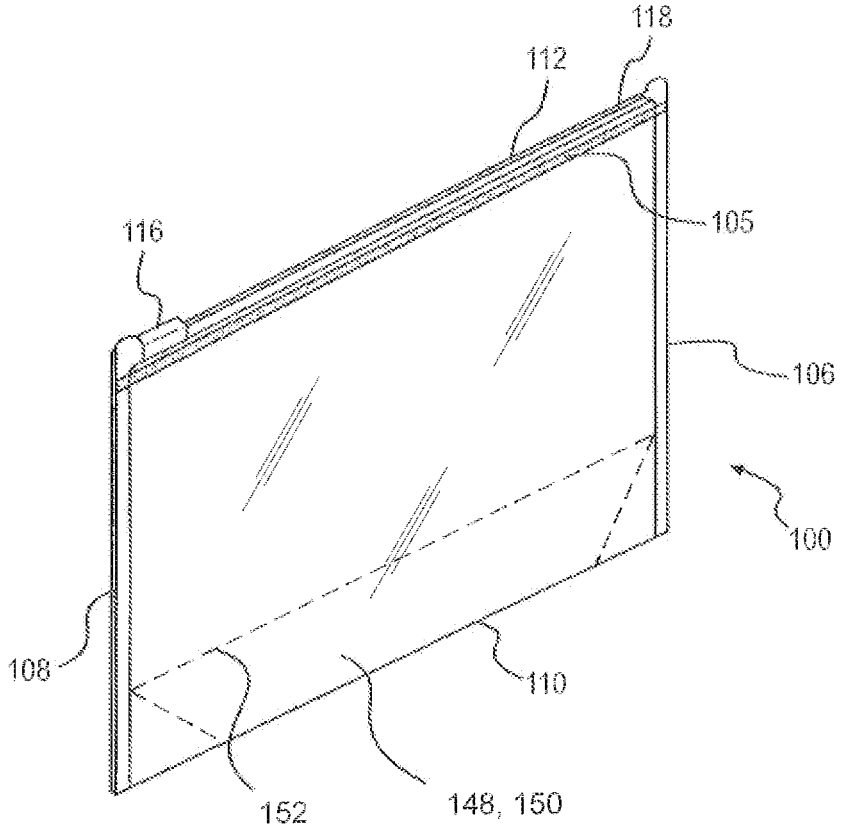
FIG. 2 is an elevation view of the bag shown in FIG. 1 in the closed and flat configuration.
Figure 3:
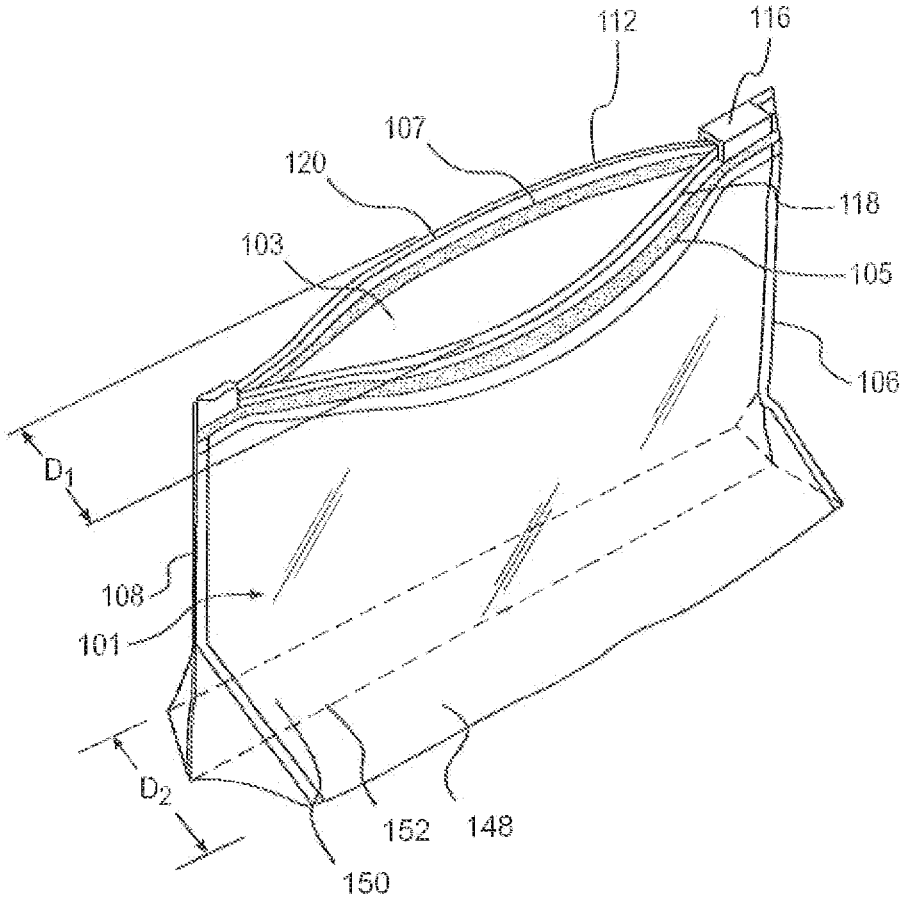
FIG. 3 is an elevation view of the bag shown in FIG. 1 in the open and extended configuration.

FIGS. 1-3 are views of a bag 100 according to an embodiment of the invention. The bag 100 includes a first side surface 102 and a second side surface 104. The first and second side surfaces 102 and 104 are directly connected along ends 106 and 108 of the bag 100. The first and second side surfaces 102 and 104 are also connected at a bottom end 110 of the bag 100. The bottom end 110 of the bag 100 includes gusset surfaces 148 and 150 between the side surfaces 102 and 104, as will be described below. An opening 103 to the interior 101 of the bag 100 is formed at the lop end 112. The opening 103 is sealable with a fastener assembly 114 and a slider 116, as will also be described below.

As will be described below, the side surfaces 102 and 104 of the bag 100 may be formed from a variety of plastic materials. As such, the side surfaces 102 and 104 may be directly laminated together at ends 106 and 108 of the bag 100. In other embodiments, however, additional surfaces may be provided to connect the first and second side surfaces 102 and 104 at ends 106 and 108 of the bag 100. For example, a gusset-type connection may be formed at the ends 106 and 108 between the first and second sides 102 and 104, thereby allowing the side surfaces 102 and 104 to expand at ends 106 and 110 in the same manner as the bottom end 110 (described below). Those skilled in the art will recognize the many configurations to form a resealable bag that includes a fastener assembly as described herein. It should also be apparent from the foregoing discussion, that the term "connected" as used herein is general and allows for either a directly attached connection, or a connection with intervening structures.

The bag 100 may be formed from a variety of materials, in embodiments of our invention, the bag 100 is formed from thermoplastics, such as, high density polyethylene (HOPE), low density polyethylene (LDPE), linear low density polyethylene (LLDPE), and polypropylene (PP). Other materials that may be used include styrenic block copolymers, polyolefin blends, elastomeric alloys, thermoplastic polyurethanes, thermoplastic copolyesters, thermoplastic polyamides, polymers and copolymers of polyvinyl chloride (PVC), polyvinylidene chloride (PVDC), saran polymers, ethylene/vinyl acetate copolymers, cellulose acetates, polyethylene terephthalate (PET), ionomer, polystyrene, polycarbonates, styrene acryloacrylonitrile, aromatic polyesters, linear polyesters, and thermoplastic polyvinyl alcohols.

In one embodiment of the invention, the sides 102 and 104 of the bag 100 are formed as a multilayer laminate structure including a sixty gauge nylon layer laminated to a 5.5 mil LDPE/LLDPE sealant layer. Other embodiments with a laminate structure include a PET layer laminated to an LDPE/LLDPE sealant layer. Still other embodiments include an LDPE/LLDPE blend. Such multilayer laminate configurations give the bag 100 more stiffness than other, single, thin layer bags. This additional stiffness aids when the bag 100 is positioned upright during a filling operation, as will be described more fully below.

The fastener assembly 114 can also be manufactured from a variety of materials such as those described above as being, capable of forming the sides 102 and 104 of the bag 100, Further, the slider 116 of the fastener assembly, which will be more fully described below, can be formed of any suitable material, such as, for example, polybutylene terephthalate, polypropylene, nylon, polystyrene, acetal, polyketone, high density polyethylene, polycarbonate, acrylonitrile butadiene styrene, or the like. Those skilled in the art will recognize numerous other possible materials to construct elements of the bag.

The bag 100 may be constructed using a variety of processes and techniques. In some embodiments, the first and second side surfaces 102 and 104 are formed from a single sheet of plastic material that is folded in a manner to create the gusset surfaces 148 and 150 at the bottom end 110. In this embodiment, the first and second side surfaces 102 and 104 are directly connected along ends 106 and 108, for example, by laminating the side surfaces 102 and 104 at ends 106 and 108. In other embodiments, each of the side surfaces 102 and 104, as well as the gusset surfaces 148 and 150, are formed as separate pieces, which are attached to create the final bag structure. Those skilled in the art will recognize numerous other methods for creating the bag structure.

The fastener assembly 114 is provided at a top end 112 of the bag 100 adjacent to the opening 103. The details of the fastener assembly are shown in FIGS. 5-10. The fastener assembly 114 includes a slider 116 that operates with first and second fastener strips 118 and 120 to seal and to unseal the opening 103. The first fastener strip 118 includes interlocking profiles 122 and 124, and the second fastener strip 120 includes interlocking profiles 126 and 128. As shown in FIG. 5, the interlocking profile 122 is positioned adjacent to the interlocking profile 124, and the interlocking profile 126 is positioned adjacent to the interlocking profile 128.

The interlocking profiles 122, 124, 126, and 128 are pressed together and separated by the slider 116 moving along the lop end 112 of the bag 100. The slider 116 includes a first sidewall 130 and a second sidewall 132, with the first and second sidewalls 130 and 132 extending the length of the slider 116. A top wall 134 connects the first and second sidewalls 130 and 132. As shown in FIG. 10, a first pressing leg 136 extends from inner surfaces of the first sidewall 130 and the top wall 134, and a second pressing leg 138 extends from inner surfaces of the second sidewall 132 and the top wall 134 lire adjacently-positioned first and second pressing legs 136 and 138 are configured to press together the first and second fastener strips 118 and 120 as the slider 116 moves along the fastener strips 116 and 120 in a direction from the end 106 to the other end 108 of the bag 100. As such, the interlocking profile 122 interlocks with the interlocking profile 126. Additionally, with the interlocking profile 122 pressed together with the interlocking profile 126, the interlocking profiles 124 and 128 are also pressed into an interlocking position.

As shown in FIGS. 9 and 11, a separating leg 140 extends from the end of the top wall 134 that is opposite to the end of the top wall 134 having the first and second pressing legs 136 and 138. The separating leg 140 is positioned on the slider 116 so as to extend between the closure profiles 122 and **12*b* such that the separating leg 140 separates the closure profiles 122 and 126 as the slider 116 is moved along the fastener strips 118 and 120 in a direction from the end 108 to end 106 of the bag 100. Thus, when moving in the direction from end 106 to end 108 of the bag 100, the slider 116 seals the first and second fastener strips 118 and 120, and when moving from the end 108 to the end 106 of the bag 100, the slider 116 unseals the first and second fastener strips 118 and 120**.

The first and second fastener strips 118 and 120 can be initially formed separate from the other parts of the bag 100. The first and second fastener strips 118 and 120 can then be connected to the first and second side surfaces 102 and 104 of the bag with a variety of techniques, such as a lamination process. Further details of the connection between the first and second fastener strips 118 and 120 and the first and second side surfaces 102 and 104 will be described more fully below.

A shape-retaining strip 105 is provided adjacent to the first fastener strip 118 and a shape-retaining strip 107 is provided adjacent to the second fastener strip 120. The shape-retaining strips 105 and 107 are made from a material that can be easily bent, but will retain the bent shape. As such, when the opening 103 is formed by unsealing and separating the first and second fastener strips 118 and 120, the shape retaining strips 105 and 107 will maintain the shape of the opening by keeping the first and second fastener strips 118 and 120 separated. In embodiments of the invention, the shape-retaining strips 105 and 107 are formed from a resin material. Examples of such resins include stretched polyolefin resins, such as polyethylene or polypropylene. More specific examples of resins that can be used to form the shape memory strips 105 and 107 include strips of resin made from high-density polyethylene (HDPE), medium-density polyethylene, low-density polyethylene (LDPE), linear low-density polyethylene (LLDPE), polypropylene (PP), ethylene-propylene copolymers, ethylene-pentene copolymers, ethylene-vinyl acetate copolymers, ethylene-(metha) acrylic acid ester copolymers, ethylene-vinyl chloride copolymers, ethylene-propylene-butene copolymers, and high-density polyethylene. As will be appreciated by those skilled in the art, when such polyolefin resins are stretched in a funning process, the ensuing resin strip can be provided with the shape-retaining properties, i.e., being easily bent, but still able to retain the bent shape. As will also be appreciated by those skilled in tire art, there are many possible alternative resins, as well as other materials, that could be used to form shape-retaining strips that have the properties described above. Additionally, further details of shape-retaining strips can be found in the aforementioned Japanese Patent Application Pub. No. 2005-88893.

It should be noted that while the depicted bag 100 is shown with two shape-retaining strips 105 and 107, in alternative embodiments, only one of the shape-retaining snips 105 and 107 may be used. Further, while the shape-retaining strips 105 and 107 in the depicted bag 100 extend continuously from one end 106 to the other end 108. In other embodiments, one or both of the shape-retaining strips 105 and 107 may be provided over only a portion of the length between the ends 106 and 108. In still other embodiments, a plurality of discontinuous shape-retaining strips are provided along the length between the ends 106 and 108. Those skilled in the art will recognize the numerous other configurations of the shape-retaining strips 105 and 107 that will achieve the functionality described herein.

There are a variety of ways that the shape-retaining strips 105 find 107 can be attached to the rest of bag 100. One embodiment of attaching the shape-retaining strips 106 and 107 to the bag 100 is shown in FIG. 5. The first and second fastener strips 118 and 120 have flanges 119 and 121 that extend below the portions of the strips 118 and 120 with the interlocking closure profiles 122, 124, 126, and 128. In this embodiment, the shape-retaining strips 105 and 107 are positioned between the flanges 119 and 121 of the fastener strips 118 and 120, and the first and second side surfaces 102 and 104 of the bag 100. The flanges 119 and 121 are laminated to the side surfaces 102 and 104 such that the flanges 119 and 121 and side surfaces are attached at points S. Given that the shape-retaining strips 105 and 107 are positioned between the connection points S, the shape-retaining strips 105 and 107 are secured to the bag 100. In order to further secure the shape-retaining strips 105 and 107 to lire bag, the shape-retaining strips 105 and 107 may be laminated to the flanges 119 and 121. Alternatively, the shape-retaining strips 105 and 107 may be laminated to the side surfaces 102 and 104. A further alternative is to laminate the shape-retaining strips 105 and 107 to both the flanges 119 and 121 and the side surfaces 102 and 104. As discussed above, the bag 100 may have a multilayer laminate structure. With the side surfaces 102 and 104 formed as a multilayer laminate, the layer forming inside surfaces of the side surfaces 102 and 104 may be selected to have a melting temperature that is conducive to the lamination of the shape-retaining strips 105 and 107 thereto.

With the configuration shown in FIG. 5, the shape-retaining strips 105 and 107 are easily integrated into the bag 100 structure. Notably, the shape-retaining strips 105 and 107 are integrated with the structure of the bag 100 without heat being applied to the functional portions of the strips. This is advantageous as applying heat to the shape-retaining strips 105 and 107 could affect their shape-retention properties. The shape-retaining strips 105 and 107 are also separated from the interior surfaces of the bag 100, and will, therefore, not come into contact with the materials being inserted into the bag. Yet, the shape-retaining strips 105 and 107 are still positioned adjacent to the opening 103, and are thereby, capable of retaining the open shape, as described above.

FIGS. 6-8 show attachments of the shape-retaining strips 105 and 107 in alternative embodiments of the invention. In the embodiment depicted in FIG. 6, the shape-retaining strips 105 and 107 are laminated to the inside surfaces of the flanges 119 and 121. In the embodiment depicted in FIG. 7, the shape-retaining strips 105 and 107 are laminated to the inside surfaces of the first and second side surfaces 102 and 104. In this embodiment, the use of a multilayer laminate structure to form the side surfaces 102 and 104, with a conducive melting temperature for the layer forming inside surfaces of the side surfaces 102 and 104, may be utilized. In the embodiment depicted in FIG. 8, the shape-retaining strips 105 and 107 are provided on the outside surfaces of the fastener strips 118 and 120, and the side surfaces 102 and 104 are connected to the fastener strips 118 and 120 below the shape-retaining strips 105 and 107.

Figure 4:
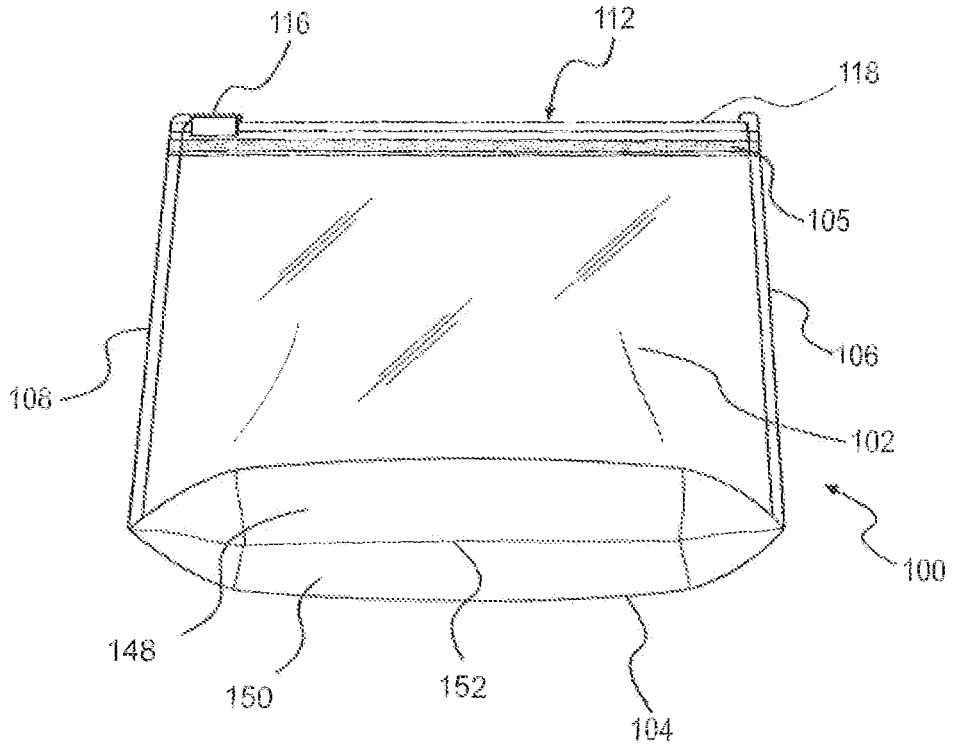

As seen in FIGS. 2-4, the bottom end 110 of the bag 100 can be moved from a flat configuration (FIG. 2) to an expanded configuration (FIGS. 3 and 4). To provide for such expansion, the bottom end 110 of the bag 100 is formed with what is often referred to as a "k-seal." More specifically, the expanding bottom end 110 includes gusset surfaces 148 and 150 provided between the side surfaces 102 and 104. The gusset surfaces 148 and 150 are separated by a fold line 152, about which the gusset surfaces 148 and 150 are folded in the flat configuration. With the gusset surfaces 148 and 150 folded, the side surfaces 102 and 104 are moved adjacent to each other at the bottom end 110, thereby providing the flat configuration of the bag 100. On the other hand, with the gusset surfaces 148 and 150 being positioned distal from each other on opposite sides of the fold line 152, the side surfaces 102 and 104 are separated at the bottom end 110 of the bag 100, thereby providing the expanded configuration.

The bag 100 in FIG. 3 is shown with the opening 103 unsealed, and the bottom end 110 in the expanded configuration. Because the shape-retaining strips 105 and 107 are positioned provided adjacent to the opening 103, when the fastener strips 118 and 120 are separated at the top end 112, the shape-retaining strips 105 and 107 maintain the opening 103 of the bag 100. The first and second side surfaces 102 and 104 may thereby be separated by a distance D1 at opening 103 at the top end 112 of the bag 100. At the bottom end 110, with the gusset surfaces 148 and 150 positioned on opposite sides of the fold line 152, the first and second surfaces 102 and 104 are separated by a distance D2. Notably, the distance D1 that the bag 100 is expanded at the top end 112 is about equal to the distance D2 that the bag 100 is expanded at the bottom end 110. As such, the bag 100 can be positioned in a substantially symmetric configuration at the top and bottom ends 112 and 110. This configuration is advantageous as it allows, for example, the bag 100 to stand upright and be opened during a process in which the bag 100 is filled with material.

As is apparent from the foregoing description, the bag 100 can be provided in a flat configuration, or in an expanded configuration. In the flat configuration, the bag 100 takes up a minimal amount of space. Thus, the flat configuration is convenient, for example, when the bag 100 is not in use and being stored. Notably, the bag 100 may be either sealed or unsealed with the fastener assembly 114 in the flat configuration. The shape-retaining strips 105 and 107 can maintain the opening in a closed position, even if the first and second fastener strips 118 and 120 are unsealed. Thus, the shape-retaining strips 105 and 107 aid in maintaining the Hat configuration of the bag.

As is also apparent from the foregoing description, in the expanded configuration, the gusset surfaces 148 and 150 are separated about the fold line 152 from each other, and the first and second side surfaces 102 and 104 can be separated from each other at the bottom end 110. Thus, the bag 100 may stand upright on the bottom end 110. The stiffer, multilayer configurations of the bag 100 described above may further aid in maintaining the bag 100 in an upright position. The bag 100 may also be cither scaled or unsealed with the fastener assembly 114 in the expanded, upright position. When unsealed, the shape-retaining strips 105 and 107 can be used to maintain the opening 103 in different shapes. Thus, the bag 100 can be manipulated to a position that makes it easy to till. Further, even after the bag 100 is filled with a material, the bag 100 may be sealed and still be maintained in the upright position.

Although this invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

INDUSTRIAL APPLICABILITY

The invention described herein can be used in the commercial production of storage bags. Such storage bags have a wide variety of uses, such as being utilized to store food, chemicals, or other substances.

We claim:

1. A storage bag consisting of:

(A) a first side surface that extends from a top end of the bag to a bottom end of the bag, the first side surface having a top edge near the top end of bag that extends from a first end of the bag to a second end of the bag;

(B) a second side surface that extends from the top end of the bag to the bottom end of the bag, the second side surface having a top edge near the top end of bag that extends from the first end of the bag to the second end of the bag, and the second side surface being directly connected to the first side surface along the first end of the bag and the second end of the bag, so as to form an interior of the bag with an opening to the bag;

(C) a first fastener strip positioned adjacent to the opening of the bag and extending from the first end of the bag to the second end of the bag, the first fastener strip having an upper end portion that extends above the top edge of the first side surface and a lower end portion that is opposite to the upper end portion, with the upper end portion of the first fastener strip being unattached to the first side surface, and the first fastener strip consisting of (a) a first interlocking profile and a second interlocking profile at the upper end portion of the first fastener strip that extends above the top edge of the first side surface, and (b) a flange extending directly below the second interlocking profile of the first fastener strip, the flange having an uppermost portion and a lowermost portion, with the flange being attached to the first side surface at (i) first connection points that extend along the top edge of the first side surface, from the first end of the bag to the second end of the bag, and (ii) second connection points that extend from the first end of the bag to the second end of the bag, the second connection points being adjacent to the lower end portion of the first fastener strip such that the lowermost portion of the flange is attached to the first side surface of the bag, and the uppermost portion of the flange extends directly to the second interlocking profile of the first fastener strip, wherein a space is created between the flange and the first side surface of the bag in an area between the first connection points and the second connection points, with the area between the first connection points and the second connection points being unattached to the first side surface to create the space between the flange and the first side surface of the bag;

(D) a second fastener strip positioned adjacent to the opening of the bag and extending from the first end of the bag to the second end of the bag, the second fastener strip having an upper end portion that extends above the top edge of the second side surface and a lower end portion that is opposite to the upper end portion, with the upper end portion of the second fastener strip being unattached to the second side surface, and the second fastener strip consisting of (a) a first interlocking profile and a second interlocking profile that define the upper end portion of the second fastener strip that extends above the top edge of the second side surface, and the first interlocking profile of the second fastener strip being configured to interlock with the first interlocking profile of the first fastener strip, and the second interlocking profile of the second fastener strip being configured to interlock with the second interlocking profile of the first fastener strip, and (b) a flange extending directly below the second interlocking profile of the second fastener strip, the flange having an uppermost portion and a lowermost portion, with the flange being attached to the second side surface at (i) first connection points that extend along the top edge of the second side surface, from the first end of the bag to the second end of the bag, and (ii) second connection points that extend from the first end of the bag to the second end of the bag, the second connection points being adjacent to the lower end portion of the second fastener strip such that the lowermost portion of the flange is attached to the second side surface of the bag, and the uppermost portion of the flange extends directly to the second interlocking profile of the second fastener strip, wherein a space is created between the flange and the second side surface of the bag in an area between the first connection points and the second connection points, with the area between the first connection points and the second connection points being unattached to the second side surface to create the space between the flange and the second side surface of the bag;

(E) a slider positioned at the upper end portion of the first fastener strip and the upper end portion of the second fastener strip by straddling the upper end portion of the first fastener strip and the upper end portion of the second fastener strip, such that the slider slides directly along the upper end portion of the first fastener strip and the first interlocking profile of the upper end portion of the second fastener strip, the slider having a separating lea that extends between the first interlocking profile and the second interlocking profile of the first fastener strip and the first interlocking profile and the second interlocking profile of the second fastener strip, with the slider being configured (a) to seal the bag by pressing together the first interlocking profile and the second interlocking profile of the first fastener strip and the first interlocking profile and the second interlocking profile of the second fastener strip as the slider moves from the first end of the bag to the second end of the bag, and (b) to unseal the bag by separating the first interlocking profile and the second interlocking profile of the first fastener strip and the first interlocking profile and the second interlocking profile of the second fastener strip using the separating leg as the slider moves from the second end of the bag to the first end of the bag;

(F) a first shape-retaining strip extending from the first end of the bag to the second end of the bag, the entire first shape-retaining strip being completely contained (a) within the space between the flange of the first fastener strip and the first side surface of the bag, and (b) in the area between the first and second connection points at which the flange of the first fastener strip is unattached to the first side surface, the first shape-retaining strip having (i) an upper edge that extends from the first end of the bag to the second end of the bag, the upper edge being spaced from the first connection points between the first end of the bag and the second end of the bag, and (ii) a lower edge that extends from the first end of the bag to the second end of the bag, the lower edge being spaced from the second connection points between the first end of the bag and the second end of the bag, such that (a) the first shape-retaining strip is provided in the space between the flange of the first fastener strip and the first side surface of the bag without applying heat between the first end of the bag and the second end of the bag, (b) the first shape-retaining strip is separate and distinct from each of (i) the flange of the first fastener strip and (ii) the first side surface of the bag, between the first end of the bag and the second end of the bag, and (c) the first shape-retaining strip being made of a material that is capable of (i) being bent into a bent shape and (ii) retaining the bent shape; and (G) a second shape-retaining strip extending from the first end of the bag to the second end of the bag, the second shape-retaining strip having substantially the same shape and configuration as that of the first shape-retaining strip, and the entire second shape-retaining strip being completely contained (a) within the space between the flange of the second fastener strip and the second side surface of the bag and (b) in the area between the first and second connection points at which the flange of the second fastener strip is unattached to the second side surface, the second shape-retaining strip having (i) an upper edge that extends from the first end of the bag to the second end of the bag, the upper edge being spaced from the first connection points between the first end of the bag and the second end of the bag, and (ii) a lower edge that extends from the first end of the bag to the second end of the bag, the lower edge being spaced from the second connection points between the first end of the bag and the second end of the bag, such that (a) the second shape-retaining strip is provided in the space between the flange of the second fastener strip and the second side surface of the bag without applying heat between the first end of the bag and the second end of the bag, (b) the second shape-retaining strip is separate and distinct from each of (i) the flange of the second fastener strip and (ii) the second side surface of the bag, between the first end of the bag and the second end of the bag, and (c) the second shape-retaining strip being made of a material that is capable of (i) being bent into a bent shape and (ii) retaining the bent shape, wherein the bag is changeable among (a) a flat, sealed configuration with (i) the first side surface positioned adjacent to the second side surface at the top end of the bag and the bottom end of the bag, (ii) the first interlocking profile and the second interlocking profile of the first fastener strip being interlocked with the first interlocking profile and the second interlocking profile of the second fastener strip, respectively, and (iii) the first and second shape-retaining strips maintaining a first position in which the first shape-retaining strip is positioned adjacent to the second shape-retaining strip at the top end of the bag, (b) a flat, unsealed configuration with (i) the first side surface positioned adjacent to the second side surface at the top end of the bag and the bottom end of the bag, (ii) the first interlocking profile and the second interlocking profile of the first fastener strip being separated from the first interlocking profile and the second interlocking profile of the second fastener strip, and (iii) the first and second shape-retaining strips maintaining the first position in which the first shape-retaining strip is positioned adjacent to the second shape-retaining strip at the top end of the bag, and (c) an expanded, unsealed, stand-up configuration with (i) the first side surface spaced a distance D2 from the second side surface at the bottom end of the bag, (ii) the first interlocking profile and the second interlocking profile of the first fastener strip being separated from the first interlocking profile and the second interlocking profile of the second fastener strip, (iii) the first and second shape-retaining strips each comprising the bent shape and (iv) the first and second shape-retaining strips maintaining a second position in which the first shape-retaining strip is positioned a distance D1 away from the second shape-retaining strip at the top end of the bag, with the distance D1 being about equal to the distance D2, so that the bag has a substantially symmetric configuration at the top end and the bottom end of the bag, and wherein the first side surface is directly connected to the second side surface at the bottom end of the bag with a connection that is changeable among (a) the flat, sealed configuration with the first side surface positioned adjacent to the second side surface at the bottom end, (b) the flat, unsealed configuration with the first side surface positioned adjacent to the second side surface at the bottom end, and (c) the expanded, unsealed, stand-up configuration with the first side surface spaced from the second side surface at the bottom end.

2. The storage bag according to claim 1, wherein the first and second shape-retaining strips are formed from a polyolefin.

3. The storage bag according to claim 1, wherein each of the first and second side surfaces has a multilayer laminate structure.

4. The storage bag according to claim 3, wherein the multilayer laminate structure of the first and second side surfaces includes a nylon layer laminated to a polyethylene layer.

5. The storage bag according to claim 1, wherein the shape-retaining strip is laminated to the flange of the first fastener strip.

6. The storage bag according to claim 1, wherein the first shape-retaining strip is laminated to the flange of the first fastener strip, and the second shape-retaining strip is laminated to the flange of the second fastener strip.

7. The storage bag according to claim 1, wherein the connection at the bottom end is formed by a first gusset surface connected to the first side surface, and a second gusset surface connected to the second side surface, with the first and second gusset surfaces being connected at a fold line.

8. The storage bag according to claim 1, wherein, when the slider moves from the second end of the bag to the first end of the bag, along (i) the upper end portion of the first fastener strip that extends above the top edge of the first side surface, and (ii) the upper end portion of the second fastener strip that extends above the top edge of the second side surface, to unseal the bag, the bag changes from the flat, sealed configuration to the flat, unsealed configuration.

9. The storage bag according to claim 8, wherein a user changes the bag from the flat, unsealed configuration to the expanded, unsealed, stand-up configuration by pulling apart (i) the upper end portion of the first fastener strip that extends above the top edge of the first side surface, and (ii) the upper end portion of the second fastener strip that extends above the top edge of the second side surface, at the top end of the bag.

* * * * *